US008602003B2

(12) United States Patent
Schoenfuss

(10) Patent No.: US 8,602,003 B2
(45) Date of Patent: Dec. 10, 2013

(54) FUEL TANK

(75) Inventor: Steffen Schoenfuss, Odenthal (DE)

(73) Assignee: Ford Global Technologies, LLC, Dearborn, MI (US)

( * ) Notice: Subject to any disclaimer, the term of this patent is extended or adjusted under 35 U.S.C. 154(b) by 477 days.

(21) Appl. No.: 12/954,393

(22) Filed: Nov. 24, 2010

(65) Prior Publication Data

US 2011/0127284 A1 Jun. 2, 2011

(30) Foreign Application Priority Data

Nov. 30, 2009 (EP) ..... 09177449

(51) Int. Cl.
*F02M 33/02* (2006.01)

(52) U.S. Cl.
USPC ..... 123/516; 123/519; 123/520

(58) Field of Classification Search
USPC ..... 123/516, 518, 519, 520, 198 D; 73/114.39
See application file for complete search history.

(56) References Cited

U.S. PATENT DOCUMENTS 5,651,349 A 7/1997 Dykstra et al.
5,845,625 A * 12/1998 Kidokoro et al. ..... 123/520
5,890,474 A * 4/1999 Schnaibel et al. ..... 123/520
6,105,557 A * 8/2000 Schnaibel et al. ..... 123/520
6,131,550 A * 10/2000 Fritz et al. ..... 123/520
6,161,423 A * 12/2000 Okuma ..... 73/40
6,182,642 B1 * 2/2001 Ohkuma ..... 123/520
6,234,152 B1 * 5/2001 Fritz et al. ..... 123/520
6,250,288 B1 * 6/2001 Fritz ..... 123/520
6,446,615 B2 * 9/2002 Stegmann et al. ..... 123/520
6,550,315 B2 * 4/2003 Streib ..... 73/49.7
6,568,374 B2 * 5/2003 Balsdon et al. ..... 123/519
6,672,291 B2 * 1/2004 Balsdon et al. ..... 123/519
6,722,348 B2 * 4/2004 Nagasaki et al. ..... 123/520
6,761,154 B2 * 7/2004 Takagi et al. ..... 123/520
6,820,467 B2 * 11/2004 Streib ..... 73/49.2
6,834,535 B2 * 12/2004 Kano et al. ..... 73/49.7
6,889,667 B2 * 5/2005 Fritz et al. ..... 123/520
6,959,587 B2 * 11/2005 Schulz et al. ..... 73/49.7
6,988,396 B2 * 1/2006 Matsubara et al. ..... 73/114.39
7,004,013 B2 * 2/2006 Kobayashi et al. ..... 73/49.7
7,059,177 B2 * 6/2006 Kobayashi et al. ..... 73/114.39
7,107,827 B2 * 9/2006 Kobayashi et al. ..... 73/114.39
7,162,914 B2 * 1/2007 Streib et al. ..... 73/49.7

(Continued)

FOREIGN PATENT DOCUMENTS

EP 1510804 B1 3/2007

OTHER PUBLICATIONS

ISA European Patent Office, Search Report of EP 09 17 7449, May 4, 2010, 5 pages.

*Primary Examiner* — Thomas Moulis
(74) *Attorney, Agent, or Firm* — Julia Voutyras; Alleman Hall McCoy Russell & Tuttle LLP

(57) ABSTRACT

The present application relates to a fuel tank, which has a vent line from a fresh air filter to a hydrocarbon filter element. It is proposed that a diagnostic valve be permanently arranged between the fresh air filter and the hydrocarbon filter element, the diagnostic valve comprising an operating port, which in an operating position forms a passage for operating gases, and a diagnostic port, which in a diagnostic position can be connected to an external pressure-generating device, and which in the diagnostic position forms a diagnostic passage to the hydrocarbon filter element.

15 Claims, 7 Drawing Sheets

(56) References Cited

U.S. PATENT DOCUMENTS

| | | | | |
|---|---|---|---|---|
| 7,216,637 | B2 * | 5/2007 | Uchida et al. | 123/520 |
| 7,234,344 | B2 * | 6/2007 | Inagaki et al. | 73/114.39 |
| 7,237,432 | B2 * | 7/2007 | Inagaki et al. | 73/114.39 |
| 7,284,530 | B2 * | 10/2007 | Nagasaki et al. | 123/198 D |
| 7,350,399 | B2 * | 4/2008 | Kobayashi et al. | 73/49.7 |
| 7,360,401 | B2 * | 4/2008 | Kano | 73/47 |
| 7,441,549 | B2 * | 10/2008 | Takayanagi | 123/520 |
| 7,464,698 | B2 * | 12/2008 | Maegawa | 123/519 |
| 7,472,583 | B2 * | 1/2009 | Kato et al. | 73/49.7 |
| 7,481,101 | B2 | 1/2009 | Matsubara et al. | |
| 7,993,119 | B2 * | 8/2011 | Kobayashi et al. | 418/133 |
| 2003/0015022 | A1 * | 1/2003 | Stegmann et al. | 73/40.5 R |
| 2004/0173013 | A1 | 9/2004 | Kobayashi et al. | |
| 2005/0011185 | A1 * | 1/2005 | Annoura et al. | 60/289 |
| 2006/0016253 | A1 | 1/2006 | Kobayashi et al. | |
| 2007/0084274 | A1 | 4/2007 | Takayanagi | |

* cited by examiner

FUEL TANK

RELATED APPLICATIONS

This application claims priority to European Patent application 09177449.7 filed on 30 Nov. 2009, the entire contents of which being incorporated herein by reference.

BACKGROUND

The disclosure relates to a fuel tank, which has a vent line from a hydrocarbon filter element to a fresh air filter.

Fuel tanks usually have a plurality of lines, for example, a filling line, a vapor purge line and the vent line from the hydrocarbon filter element to the fresh air filter. Such fuel tanks with the associated line system are sufficiently known, for which reason they will not be examined in any further detail here.

The hydrocarbon filter element is embodied as an activated charcoal filter, for example, and is intended, for example, to filter hydrocarbons out of fuel gases, so that these cannot get into the surroundings. For this purpose the hydrocarbon filter element is arranged between the fuel tank and the fresh air filter of the internal combustion engine, for example.

An example fuel tank with associated line system is disclosed in U.S. Pat. No. 7,481,101 B1. A vacuum-generating pump module, which comprises a control valve and a bypass, is arranged between an activated charcoal filter and the atmosphere. Bores are made in the control valve. In a state which is termed the "OFF state", the surroundings communicate via one of the bores with the inlet side of the activated charcoal filter. In an "On State", on the other hand, the activated charcoal filter communicates via the other bore with a pump side. A closed system is thus disclosed, irrespective of whether the control valve is in its OFF or in its On state.

U.S. Pat. No. 5,651,349 also relates to a fuel tank with associated line system, U.S. Pat. No. 5,651,349 relating in particular to a method for monitoring a venting system and to the venting system itself. An activated charcoal filter is connected to the fuel tank on the one hand and to the internal combustion engine on the other. A valve is arranged on the activated charcoal filter in order to be able to admit air into the activated charcoal filter.

The fuel tank or the corresponding system is subjected to a leak test, especially on completion of the finished motor vehicle. This test is included in the so-called "end of line test", that is to say as an integral part of the final acceptance of the motor vehicle by the manufacturer. In the inspection of the fuel tank with the connected line system, the vent line is separated from the hydrocarbon filter element. An external pressure-generating device is connected to the hydrocarbon filter element, so that a corresponding pressure test can be carried out, which indicates whether the fuel tank or the corresponding line system has any leaks. Such a pressure test is commonly known. If no leaks are detected, the vent line should be connected to the hydrocarbon filter element again, so that filtered fresh air can get into the fuel tank.

Despite the quality assurance systems introduced and practiced in the motor vehicle industry, however, it can happen, due to human oversight, that the vent line is not reconnected to the hydrocarbon filter element after successfully carrying out the pressure test. In such a case, in normal operation of the motor vehicle and of the internal combustion engine, unfiltered fresh air could pass through the hydrocarbon filter element into the fuel tank. Thus, for example, liquids or solids could get into the fuel tank, since there is no connection to the fresh air filter. Such contamination is obviously regarded as particularly harmful.

SUMMARY

Accordingly, one example approach to address the above issues includes a fuel tank, which has a vent line from a fresh air filter to a hydrocarbon filter element, wherein a diagnostic valve arranged between the fresh air filter and the hydrocarbon filter element comprises an operating port, which in an operating position forms a passage for operating gases, and a diagnostic port, which in a diagnostic position is connected to an external pressure-generating device, and which in the diagnostic position forms a diagnostic passage to the hydrocarbon filter element.

In this way, it is possible to improve a fuel tank of the aforementioned type by simple means so that even after carrying out its pressure test, a connection of the filter element to the fresh air filter is ensured without any special measures.

According to another aspect of the disclosure, there is provided a method for controlling an emissions control system including a vapor purge line fluidically coupling a fuel tank to a hydrocarbon filter element, a vent line positioned between the hydrocarbon filter element and atmosphere, a valve having a first, second, and third connection ports, the valve arranged within the vent line between the hydrocarbon filter element and a fresh air filter arranged on the atmosphere side of the vent line, the method comprising:

during a first operating mode, routing vapors from the hydrocarbon filter element via the second port through the valve to the atmosphere via the first port with the valve in a first position; and during a second operating mode, routing fresh air from the atmosphere via the first port through the valve to the hydrocarbon filter element via the second port with the valve in the first position, wherein the valve includes a second position for fluidically coupling the second port with the third port.

It is therefore possible to store or purge fuel vapors while constantly maintaining the valve between the hydrocarbon filter element and the fresh air filter. The diagnostic valve is not just fitted additionally between the hydrocarbon filter element and the fresh air filter for a so-called "end of line test", but arranged constantly, that is to say permanently, between the hydrocarbon filter element and the fresh air filter, and is fitted prior to the pressure test, and is not removed again after the pressure test. This ensures that the vent line no longer has to be detached from the filter element in order to carry out a pressure test, which advantageously serves to ensure that fresh air flowing through the fresh air filter gets into the fuel tank. It is furthermore advantageous that when necessary a pressure test can be carried out by means of the permanently arranged or fitted diagnostic valve, simply by connecting an external pressure-generating device to the diagnostic valve. A leak test to be carried out after the "end of line test" may be necessary, for example, if corresponding monitoring facilities indicate malfunctions and/or leaks. Such a pressure test could be carried out in suitably equipped workshops and could be conducted externally without removing equipment or requiring operation of the vehicle.

Further advantageous developments are disclosed in the claims and in the following description of the figures, of which

DETAILED DESCRIPTION

Figure 1:
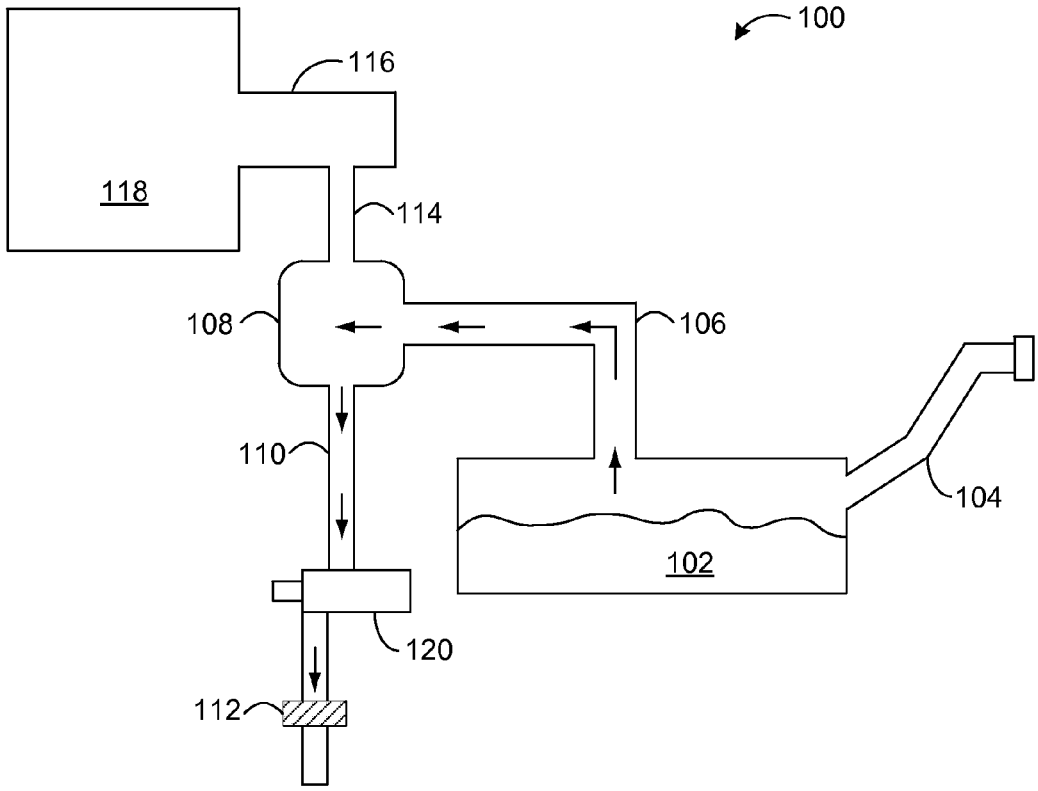
FIG. 1 shows a fuel tank and associated line system in vapor storage mode.

In the different figures the same parts are always provided with the same reference numerals, so that these are generally also described only once.

FIG. 1 schematically shows a fuel system 100 in vapor storage mode. Fuel system 100 comprises a fuel tank 102 with a fuel filling line 104. Attached to the fuel tank 102 is a vapor purge line 106 that connects with a hydrocarbon filter element 108. Hydrocarbon filter element 108 has a vent line 110 to a fresh air filter 112 and a purge line 114 to the intake manifold 116 and engine 118. Situated on the vent line 110 between the filter element 108 and fresh air filter 112 is a diagnostic valve 120. FIG. 1 represents an example embodiment in which the engine 118 is not running and the fuel vapors produced in the fuel tank 102 are vented through the vapor purge line 106 to the hydrocarbon filter element 108 and out to the atmosphere through the vent line 110. The hydrocarbons are trapped by the filter element 108. In this particular embodiment, the diagnostic valve 120 is in its operating mode.

Figure 2:
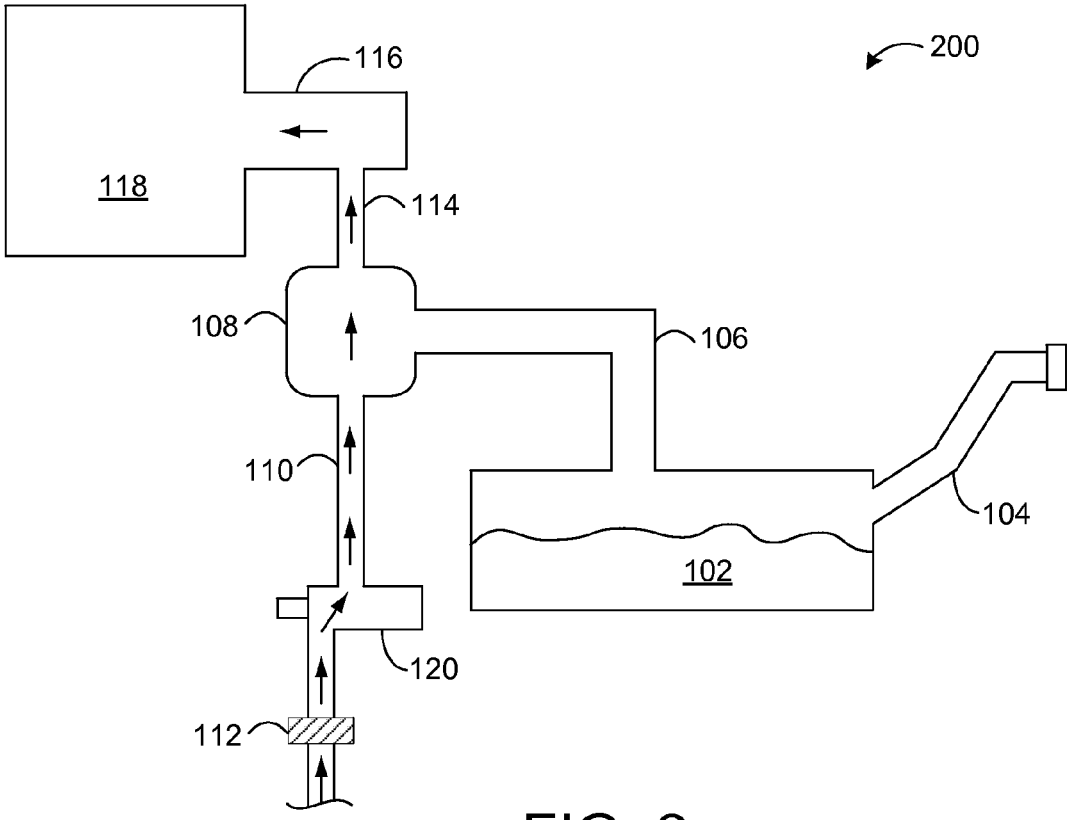
FIG. 2 shows a fuel tank in vapor purge mode.

FIG. 2 schematically shows a fuel system 200 in vapor purge mode. The engine 118 is running and air is flowing through the fresh air filter 112 and the diagnostic valve 120, which is in its operating mode. The air moves through the hydrocarbon filter element 108 and into the intake manifold 116 and engine 118. The hydrocarbons trapped in the hydrocarbon filter element 108 are passed into the engine 118 to be combusted.

Figure 3:
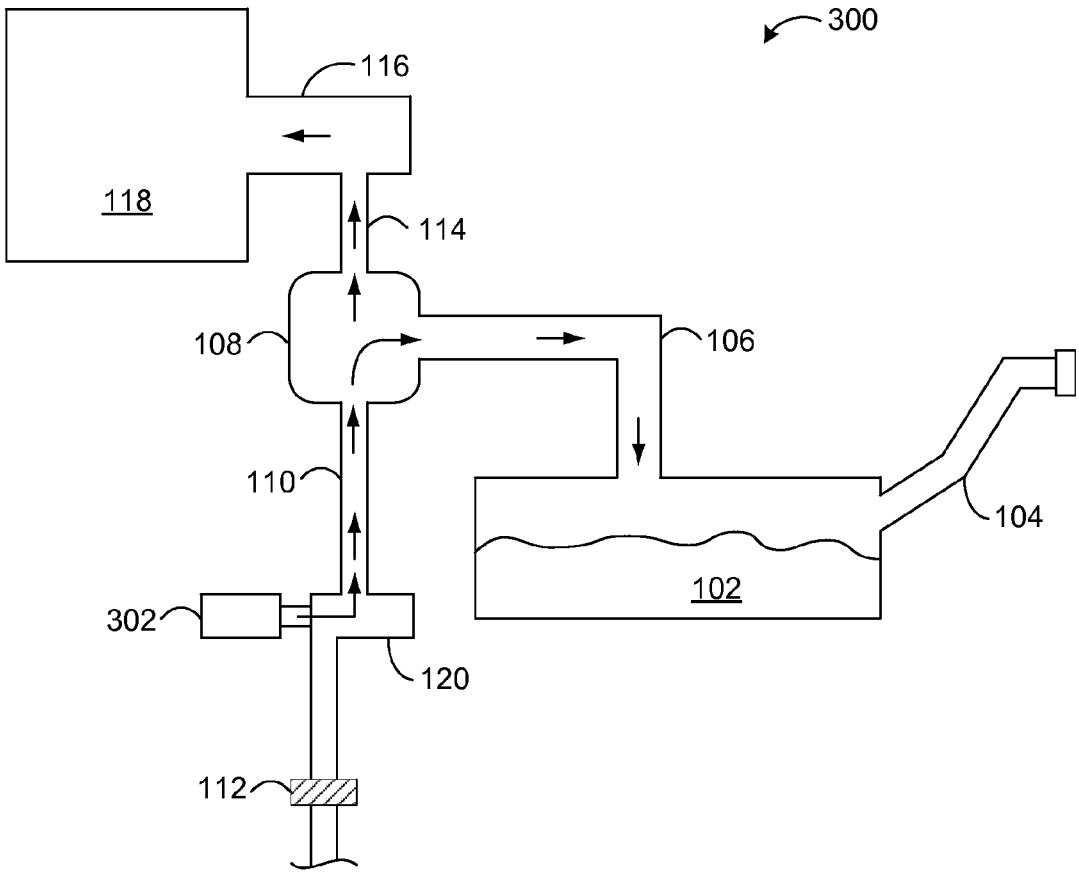
FIG. 3 shows a fuel tank in diagnostic mode.

FIG. 3 schematically shows a fuel system 300 in pressure test mode. Engine 118 is not running and a pressure generating device 302 has been connected to the diagnostic valve 120. The diagnostic valve 120 shifts into its diagnostic position due to the interconnection with the pressure generating device 302 when it is connected to the pressure generating device 302. In one example, the physical insertion of the pressure generating device 302 engages the diagnostic valve in a way to physically move the position of the valve. Upon operation of the pressure generating device 302, compressed air passes through the diagnostic valve and into the fuel tank and corresponding line system. Leaks in the fuel tank and corresponding line system can thus be detected.

Figure 4:
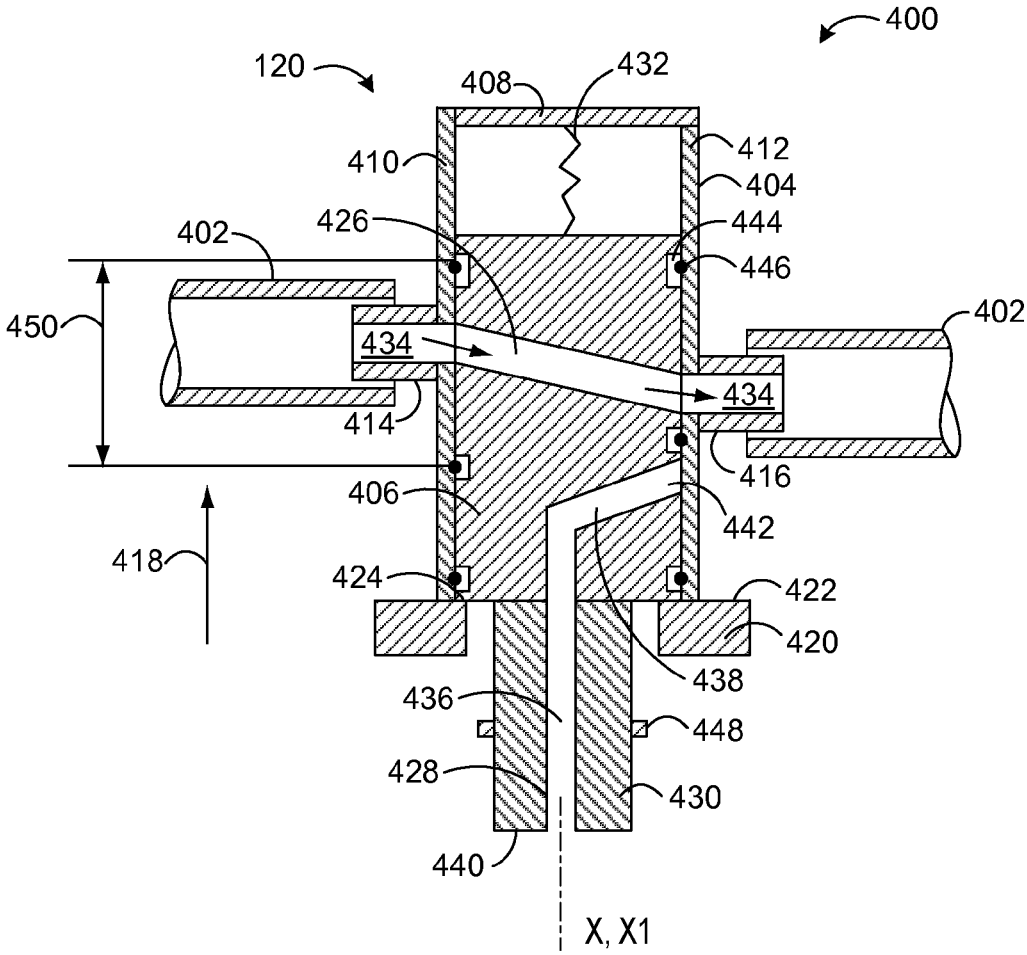
FIG. 4 shows a longitudinal section through a diagnostic valve in its operating position.

FIG. 4 shows an operating position 400 for the diagnostic valve 120. The diagnostic valve 120 is arranged, for example, in a vent line 402, which extends from a fresh air filter (not shown) to a hydrocarbon filter element (not shown), the hydrocarbon filter element preferably being embodied as an activated charcoal filter.

The vent line 402 running on the left-hand side of the diagnostic valve 120 in the drawing plane, for example, leads to the fresh air filter, the opposite (right-hand) side leading to the hydrocarbon filter element. The diagnostic valve may also be directly connected to a corresponding outlet of the fresh air filter or to a corresponding inlet of the hydrocarbon filter element (relative to the direction of flow of the fresh air).

Said components are a part of a fuel tank and its line system of a motor vehicle having an internal combustion engine. The diagnostic valve 120 serves for carrying out a pressure test on the fuel tank and the associated system, for example as part of a so-called "end of line test". The diagnostic valve 120 is advantageously permanently fitted and is not removed after the pressure test.

It is useful if the diagnostic valve 120 comprises a housing 404, in which a body 406 is arranged. The body 406 can be brought from the operating position 400 into a diagnostic position 500 described in FIG. 5. The body 406 is held securely in place in the respective position by elements discussed below. In the longitudinal section shown the housing 404 has a U-shaped configuration with a head side 408 and two U-legs 410, 412. On the foot side, that is opposite the head side 408, the housing 404 is open. In one development, the body is of cylindrical and possibly solid design when viewed in longitudinal section.

Figure 5:
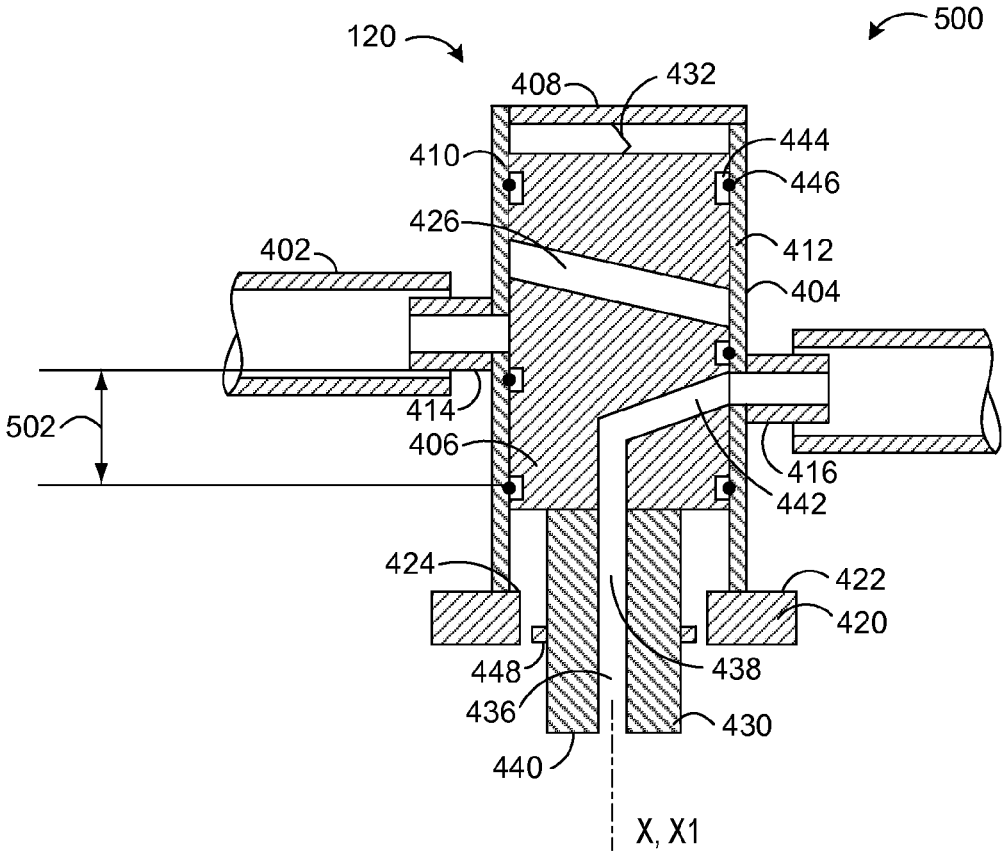
FIG. 5 shows the diagnostic valve from FIG. 4 in its diagnostic position.

The U-leg 410 is arranged on the fresh air filter side of the diagnostic valve 120, the U-leg 412 being oriented towards its hydrocarbon filter element side. It is useful if the diagnostic valve comprises connecting ports, which can be medium-tightly connected to a hydrocarbon filter side and to a fresh air filter side of the vent line. On the fresh air filter side a first connecting port 414 is arranged on the U-leg 410, a second connecting port 416 being arranged on the opposite hydrocarbon filter element side. The two connecting ports 414 and 416 are embodied, for example, as socket connections, which with their outer circumference are matched to the corresponding inner circumference of the vent line 402, on which the vent line 402 to the corresponding section is medium-tightly attached. The gaps discernible in FIGS. 4 and 5 are exaggerated and do not exist in practice.

The connecting ports 414 and 416 are arranged with height offset relative to one another in a vertical direction (arrow 418) indicated in the drawing plane, which means that in relation to the head side 408 the connecting port 416 is arranged lower than the connecting port 414.

Arranged on the foot side of the housing 404 is a retaining ring 420, which projects beyond the housing wall both towards a center axis X and away from this, so that a retaining surface 422 is formed on the outside and a seating step 424 on the inside.

An operating port 426 and a diagnostic port 428 are arranged in the body 406. On the foot side of the body 406 is an auxiliary external input connection 430, which has a smaller diameter than the body 406. A stored-energy element 432, embodied as a spring element in the exemplary development, is arranged on the head side of the body 406. The stored-energy element 432 or the spring element is connected at the other side to the head side 408 of the housing 404.

In the exemplary embodiment represented in FIG. 4 the diagnostic valve 120 is shown in its operating position 400. In the operating position 400 the operating port 426 is arranged in alignment with the two connecting ports 414, 416 and with the passage openings arranged in each of them respectively. The operating port 426 is arranged so that in the operating position a connection is formed from the fresh air filter-side (first) connecting port 414 to the hydrocarbon filter element-side (second) connecting port 416, that is to say a passage 434 for operating gases. Operating gases are filtered fresh air and fuel gases, for example. Since the two connecting ports 414 and 416 are arranged with a height offset in relation to one another, in the sectional view represented the operating port 426 is correspondingly designed to run obliquely in relation to the center axis X from the head side 408 towards the foot side. It is also feasible, however, to arrange each of the opposing connecting ports 414, 416 at similar heights in relation to one another. In such a development it is advisable for the operating port 426 to have a correspondingly rectilinear course, that is to say transverse to a center axis, in order to form the passage for operating gases.

The diagnostic port 428 comprises two sections 436 and 438, that is to say an inlet section 436, which merges into an outlet section 438. The inlet section 436 is led parallel to the center axis X running though the auxiliary external input connection 430 into the body 406. The inlet section 436 is introduced with its center axis X1 congruent with the center axis X, that is to say centrally into the diagnostic valve 120 or its body 406. On the foot side, that is to say on the exposed end face 440 of the auxiliary external input connection 430, the inlet section 436 opens into the surroundings when the diagnostic valve 120 is located in the operating position. The diagnostic port 428 is designed so that a contact or a connection to one of the connecting ports is prevented in the operating position 400.

In relation to the center axis X the outlet section 438 is arranged at an angle, preferably at an acute angle, to the inlet section 436 and opens with its orifice opening 442 on an outer circumference of the body 406.

In order to seal the outer circumference of the body 406 against the inner circumference of the housing 404, circumferential grooves 444, into each of which a sealing element 446, for example in the form of an O-sealing ring, is inserted, which conforms tightly both to the base of the groove and to the inside wall of the housing 404, are arranged on the outer circumference of the body 406. For example, multiple sealing elements (and grooves) are provided, which are arranged so that the connecting ports 414, 416 and their passage openings are sealed off by two sealing elements arranged at a vertical interval from one another. Viewed in a vertical direction the passage opening is therefore arranged between the two sealing elements. In this example, three grooves 444 are each provided with a sealing element 446.

Firm-seating elements 448, for example channels or toothed catch elements, may be arranged on the outer circumference of the auxiliary external input connection 430.

When an external pressure-generating device is connected to the diagnostic valve or to the connection fitting arranged on the body, a pressure test can be carried out in a known manner. In order to carry out a pressure test the auxiliary external input connection 430 is connected to an external pressure-generating device. For this purpose an attachment end of a line element may be slipped on to the auxiliary external input connection 430. In so doing the body 406 is pushed into the interior of the housing from the operating position 400 into the diagnostic position against the force of the stored-energy element 432. FIG. 5 shows the diagnostic position 500 in which the body 406 is pushed towards the head side 408 of the housing 404 against the force of the stored-energy element 432, so that the diagnostic port 428 with its outlet section 438 or its orifice opening 442 forms a connection with the hydrocarbon filter element-side (second) connecting port 416. In this way a connection is established from the external pressure-generating device via the diagnostic port 428 to the hydrocarbon filter element and so on, so that a pressure test can be carried out. In the diagnostic position 500 the operating port 426, as shown, no longer has any connection either to the connecting port 414 or to the second connecting port 416 or to their passage openings. Only when the body 406 is situated in the diagnostic position 500 is the diagnostic port 428 connected to the connecting port 416 oriented towards the hydrocarbon filter element and to its passage opening.

Once the body 406 has reached the diagnostic position 500, suitable elements are used to fix the body securely in the diagnostic position. For this purpose a retaining element, which interacts with a retaining ring 420 arranged on the housing 404, and which acting against the force of the stored-energy element 432 or against the spring force firmly holds the body in place in the diagnostic position, may be provided on an attachment line element of the pressure-generating device. Firm-seating elements 448, which interact with correspondingly designed mating elements on the attachment line element of the pressure-generating device, may furthermore also be arranged externally on the auxiliary external input connection 430. The retaining ring 420 may also have grooves or the like on its surface, in order to form virtual detent positions for the retaining element or its effective retaining area. Components other than those specified may naturally also serve to secure the diagnostic position.

As can be seen from FIGS. 4 and 5, the grooves 444 and sealing elements 446 are arranged so that in one of the respective positions 400 or 500 the passage openings in the connecting ports 414 and 416 are enclosed by two vertically adjacent sealing elements 446, so that either a diagnostic sealing area 450 or an operational sealing area 502 is formed. In the diagnostic position 500 the foot side of the body 406 or its exposed end face is guided by the auxiliary external input connection 430 arranged thereon into the interior of the housing 404.

If the attachment line element is removed from the auxiliary external input connection 430, the body 406 is returned from the diagnostic position 500 into the operating position 400 (FIG. 4) due to the force stored in the stored-energy element 432, that is to say preferably by a relaxation of the spring element. The seating step 424, which virtually serves as movement-limiting element and ensures that the body 406 in its movement is arrested precisely in the necessary operating position 400 so that the operating port 426 can form the passage 434, is here advantageously arranged on the retaining ring 420. This advantageously has a dual function. The retaining ring 420 serves on the one hand for fixing the body 406 securely in the diagnostic position 500. On the other hand the retaining ring 420 with its seating step 424 arranged thereon serves as abutment for the body 406 in its operating position 400.

In the operating position 400 the diagnostic valve 120 may remain permanently arranged in the vent line 402. Thus in a simple development the diagnostic valve can easily be permanently and medium-tightly connected via a plug-in connection to the corresponding components, but is purposely detachable there from. Reinforcing elements, in the form of a screw clamp, for example, can naturally also be provided, in order to ensure that each connection is permanently medium-tight but purposely detachable. It is advantageous that pressure tests can thereby also be carried out outside the "end of line tests", that is to say, for example, in response to corresponding warnings during the service life of the motor vehicle.

The disclosed system serves to ensure that a pressure test can be carried out without the need to remove the vent line from the hydrocarbon filter element, which is preferably embodied as an activated charcoal filter, since the diagnostic valve is permanently fitted. This also obviates the need for a reconnection, so that without any special measures it is possible to ensure that fresh air always reaches the fuel tank and its line system having flowed through and being filtered in the fresh air filter, thereby avoiding contamination.

Figure 6:
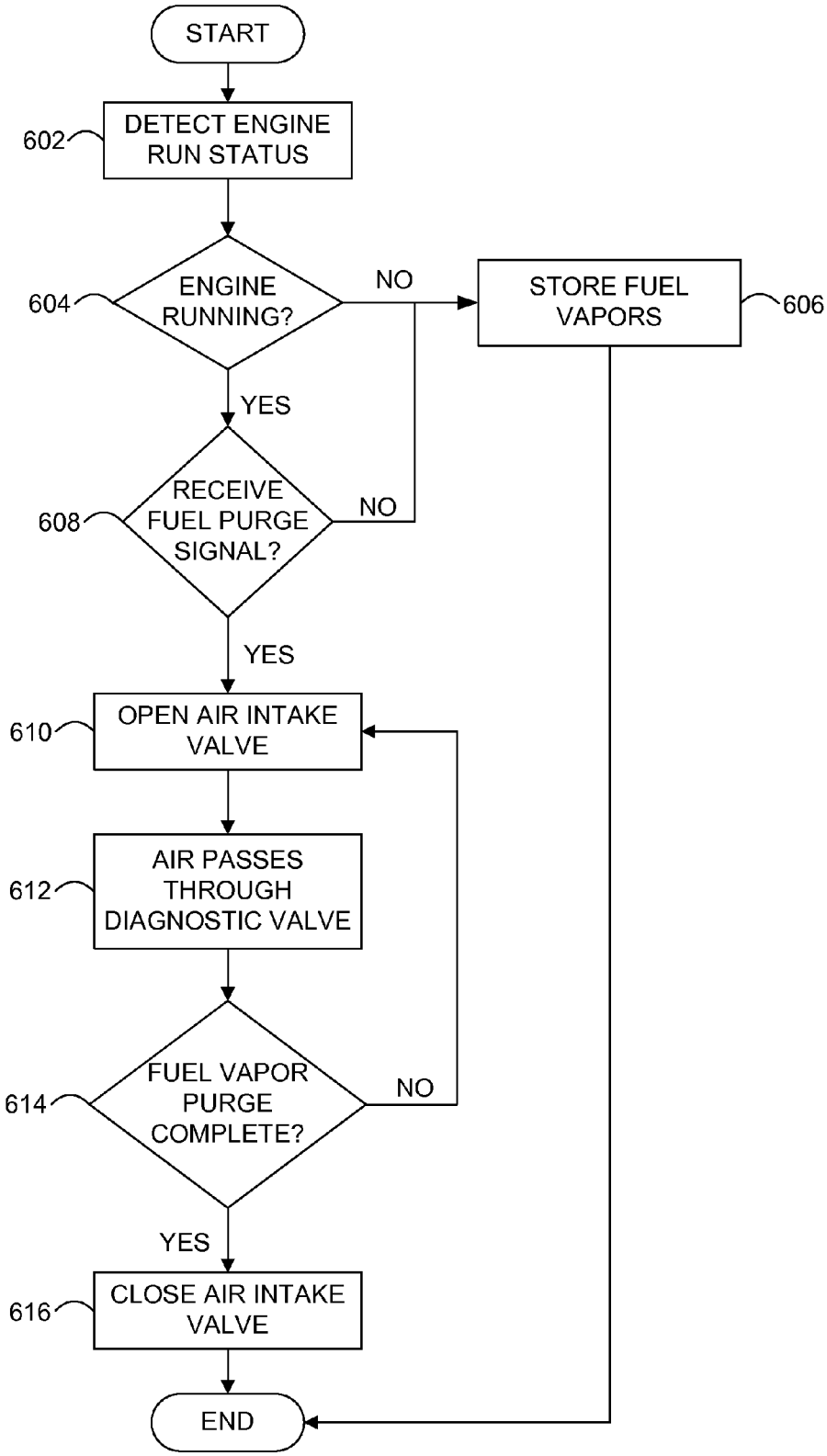
FIG. 6 shows a flow chart for various operating modes.

FIG. 6 is a flow chart of various modes of handling vapors in a fuel system. At 602 the engine run status is assessed. If the engine is not running at 604, hydrocarbons from fuel vapors are stored in a hydrocarbon filter element at 606 as depicted in FIG. 1. If the engine is running, fuel vapor purge status is assessed at 608. If the vapors do not need to be purged, the vapors are stored at 606. If the fuel vapors do need to be purged, a signal is sent to open an air intake valve at 610. The air is passed through the fresh air filter and diagnostic valve to the hydrocarbon filter element and the engine at 612 as described in FIG. 2. The status of the vapor purge is assessed at 614 and if the vapor purge is complete, the air intake valve is closed at 616.

Figure 7:
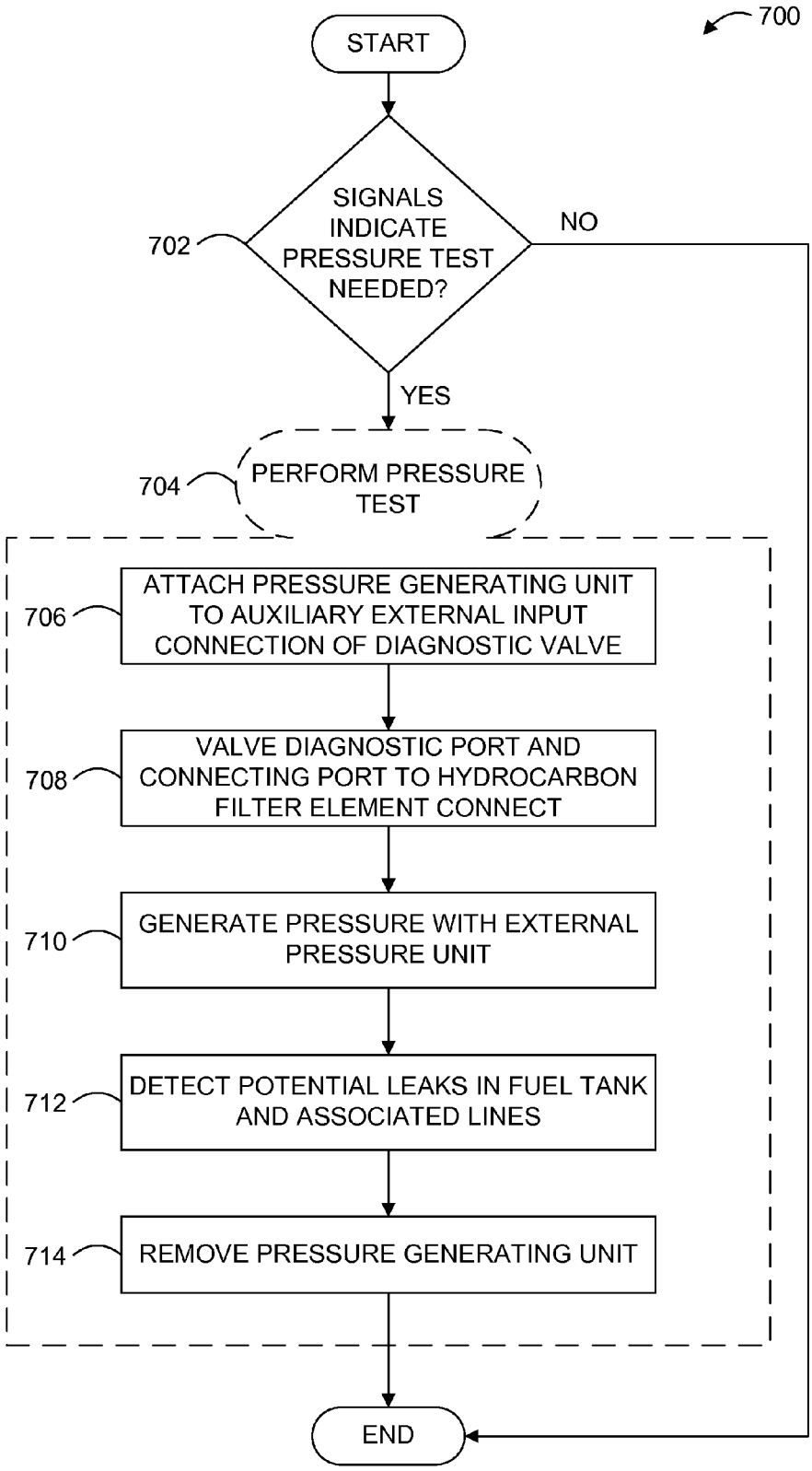
FIG. 7 shows a flow chart for the diagnostic mode.

FIG. 7 describes a method 700 for performing a pressure test using the diagnostic valve. If signals at 702 indicate a pressure test is required, the method is initiated at 704 by a user attaching an external pressure generating device to the auxiliary external input connection of the diagnostic valve at 706. This causes the diagnostic port and the connecting port to the hydrocarbon filter element to connect at 708. Pressure can then be generated at 710 with the external pressure device. Any leaks in the fuel tank or associated lines can be subsequently detected in 712 and once the pressure test is completed the external pressure device can be removed at 714.

The invention claimed is:

1. A fuel tank, which has a vent line from a fresh air filter to a hydrocarbon filter element wherein a diagnostic valve arranged between the fresh air filter and the hydrocarbon filter element comprises:

a body arranged in a housing, a foot side of the body including an auxiliary external input extension having a smaller diameter than a diameter of the body, a stored-energy element being arranged on a head side of the body and coupled between the housing and the body, an operating port, which in an operating position forms a passage for operating gases, and a diagnostic port, which in a diagnostic position is connected to an external pressure-generating device, and which in the diagnostic position forms a diagnostic passage to the hydrocarbon filter element.

2. The fuel tank as claimed in claim 1, wherein the diagnostic valve is permanently arranged between the fresh air filter and the hydrocarbon filter element.

3. The fuel tank as claimed in claim 1, wherein the diagnostic valve comprises connecting ports, which serve for connecting the diagnostic valve medium-tightly to the vent line and/or the fresh air filter and/or the hydrocarbon filter element.

4. The fuel tank as claimed in claim 1, wherein both the operating port and the diagnostic port are arranged in the body, it being possible to bring the body from its operating position into its diagnostic position and back.

5. The fuel tank as claimed in claim 4, wherein the auxiliary external input extension is configured to connect to the external pressure-generating device, the diagnostic port being led through the auxiliary external input extension and the body to an outer circumference of the body.

6. The fuel tank as claimed in claim 4, wherein the diagnostic valve or its body is fixed in its diagnostic position.

7. The fuel tank as claimed in claim 1, wherein the diagnostic port comprises an inlet section and an outlet section, which in the diagnostic position is connected to the hydrocarbon filter element.

8. A fuel system, comprising:

a vapor purge line fluidically coupling a fuel tank to a hydrocarbon filter element;

a vent line positioned between the hydrocarbon filter element and atmosphere; and a valve arranged within the vent line between a fresh air filter in the vent line and the hydrocarbon filter element, the valve having a first position fluidically coupling the hydrocarbon filter element with the atmosphere, and a second position fluidically coupling the hydrocarbon filter element with an auxiliary external input connection of the valve, the valve moved between the first position and the second position mechanically via force applied during connection of an external pressure generating device onto the auxiliary external input connection, and wherein the valve has a body arranged in a housing, the auxiliary external input connection arranged on a foot side of the body and having a smaller diameter than a diameter of the body, a stored-energy element being arranged on a head side of the body and coupled between the housing and the body.

9. The fuel system of claim 8, wherein in the second position, the atmosphere is blocked from the hydrocarbon filter element.

10. A method controlling an emissions control system including a vapor purge line fluidically coupling a fuel tank to a hydrocarbon filter element, a vent line positioned between the hydrocarbon filter element and atmosphere, a valve having a first, second, and third connection port, the valve arranged within the vent line between the hydrocarbon filter element and a fresh air filter arranged on an atmosphere side of the vent line, the method comprising:

during a first operating mode, routing vapors from the hydrocarbon filter element via the second port through the valve to the atmosphere via the first port with the valve in a first position;

during a second operating mode, routing fresh air from the atmosphere via the first port through the valve along a path arranged substantially perpendicular to a central axis of the valve to the hydrocarbon filter element via the second port with the valve in the first position, wherein the valve includes a second position for fluidically coupling the second port with the third port; and during a diagnostic mode with the valve in the second position, routing compressed air generated by an external pressure-generating device through the valve via an inlet parallel to the central axis and an outlet to the hydrocarbon filter element, the outlet arranged at an acute angle to the inlet, the valve having a body arranged in a housing, the external pressure-generating device connected to the valve via an auxiliary external input connection arranged on a foot side of the body, the auxiliary external input connection having a smaller diameter than a diameter of the body, and wherein a stored-energy element is arranged on a head side of the body and coupled between the housing and the body.

11. The method of claim 10, wherein the first connection port is fluidically coupled to the atmosphere side of the vent line, the second connection port is fluidically coupled to the hydrocarbon filter side of the line, and the third connection port is open to the atmosphere.

12. The method of claim 10, wherein the first position comprises the first port fluidically coupled to the second port.

13. The method of claim 10, wherein in the second position, the second port is fluidically coupled to the third port.

14. The fuel system of claim 8, wherein the body is slidingly connected to the housing and wherein when the valve is in the second position, the body is pushed into an interior of the housing against a force of the stored-energy element.

15. The fuel system of claim 8, further comprising a retaining ring arranged on the housing and configured to engage with a retaining element of the external pressure generating device to act against a force of the stored-energy element to hold the body in the second position.

* * * * *